United States Patent [19]

Horiuchi

[11] 4,063,376

[45] Dec. 20, 1977

[54] CLOTHING PRESSER

[75] Inventor: Kei Horiuchi, Tokyo, Japan

[73] Assignee: Toshin Seiki Kabushiki Kaisha, Tokyo, Japan

[21] Appl. No.: 758,310

[22] Filed: Jan. 10, 1977

[30] Foreign Application Priority Data

Jan. 20, 1976 Japan ..... 51-5310

[51] Int. Cl.[2] ..... D06F 71/08

[52] U.S. Cl. ..... 38/41; 38/17; 223/73

[58] Field of Search ..... 38/17, 27, 36, 37, 40, 38/41; 223/70, 57, 67, 73, 74, 72

[56] References Cited

U.S. PATENT DOCUMENTS

| | | | |
|---|---|---|---|
| 1,930,349 | 10/1933 | Pendleton | 38/41 |
| 2,228,049 | 1/1941 | Cleghorn | 38/41 |

*Primary Examiner*—G. V. Larkin

*Attorney, Agent, or Firm*—Bacon & Thomas

[57] ABSTRACT

A clothing presser is provided with a stationary ironing buck, a movable ironing head, a rocking arm having the head mounted on its forward end and adapted to swing to bring the head onto the buck, and a toggle mechanism operated by a pneumatically operated piston-cylinder assembly to impart an additional force to the head to permit the head to be strongly pressed against clothing on the buck.

3 Claims, 4 Drawing Figures

CLOTHING PRESSER

BACKGROUND OF THE INVENTION

This invention relates to a clothing presser for pressing clothing, particularly for pressing the front of the waist portion of trousers, with a powerful additional force.

DESCRIPTION OF THE PRIOR ART

In general, a clothing presser has a stationary ironing buck and a movable ironing head adapted to be moved toward and away from the buck. The head is brought into pressure contact with clothing on the buck to permit the clothing to be pressed between the head and the buck. The head is mounted on one end of a rocking arm and, when the rocking arm is swung by the actuation of a pneumatically operated piston-cylinder mechanism mounted on the other side of the rocking arm, the head on the rocking arm is pressed against the buck.

With the conventional presser, however, no great pressure can be generated since not only a piston-cylinder assembly is operated by an air pressure but also this pressure is determined by the lever ratio of the rocking arm. In consequence, the clothing can not be sufficiently pressed.

SUMMARY OF THE INVENTION

Accordingly, an object of this invention is to provide a clothing presser in which a toggle mechanism is combined with a pneumatically operated piston-cylinder assembly to permit clothing to be strongly pressed with an added pressure.

According to this invention there is provided a clothing presser comprising a stationary ironing buck, a movable ironing head, a rocking arm having the head mounted on one end thereof and adapted to swing to bring the head onto the buck, a pneumatically operated piston-cylinder assembly for causing the rocking arm to be swung, and a toggle mechanism operated by the piston-cylinder assembly and rocking arm to impart an additional pressure to the head to permit the head to be strongly pressed against clothing on the buck.

With the clothing presser according to this invention an added pressure resulting from the toggle mechanism is applied to the head on the rocking arm through a pneumatically operated piston-cylinder assembly supported by the toggle mechanism. In consequence, the head on the rocking arm is strongly pressed against the buck to permit the clothing on the buck to be strongly pressed therebetween without the necessity of using any powerful, large sized pneumatically operated piston-cylinder assembly and expensive hydraulic device.

DETAILED DESCRIPTION OF THE PREFERRED EMBODIMENTS

This invention will be explained as applied to the pressing of the front of the waist portion of trousers.

Figure 1:
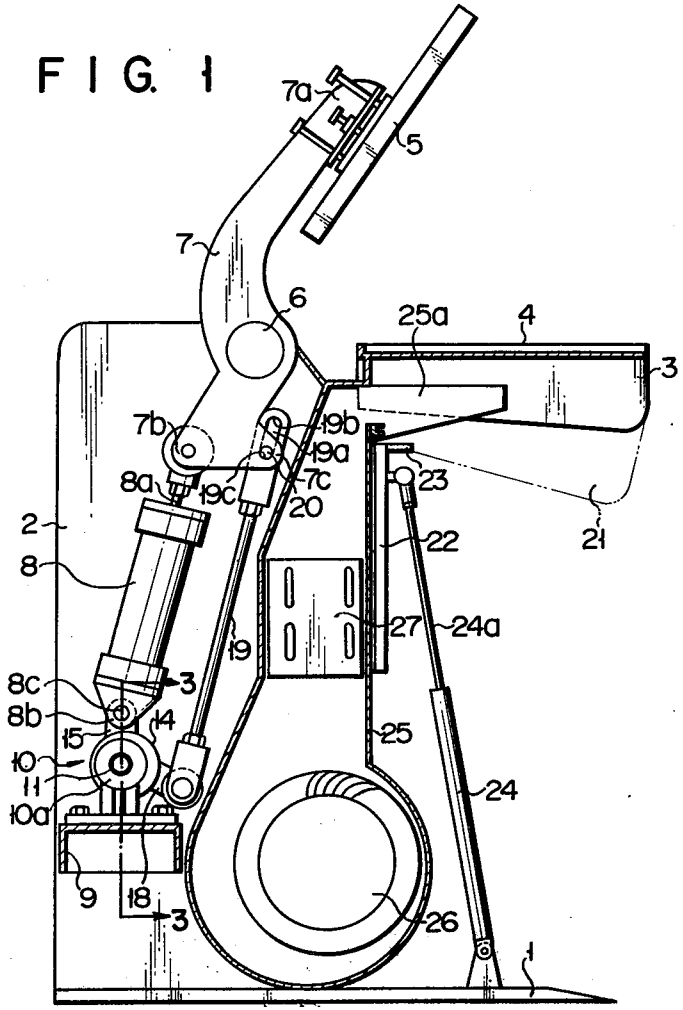
FIG. 1 is a left side elevational view, partly in cross section, showing the inoperative state of a clothing presser according to this invention.

In FIG. 1 two mutually facing upright support plates 2 (only one is shown) are mounted on a base 1 and a stationary ironing buck 3 is provided on the upper portions of these support plates 2 so as to extend horizontally therefrom. A mat 4 is mounted on the buck 3 and a movable ironing head 5 is adapted to be brought into pressure contact with the mat 4 on the buck 3.

Figure 2:
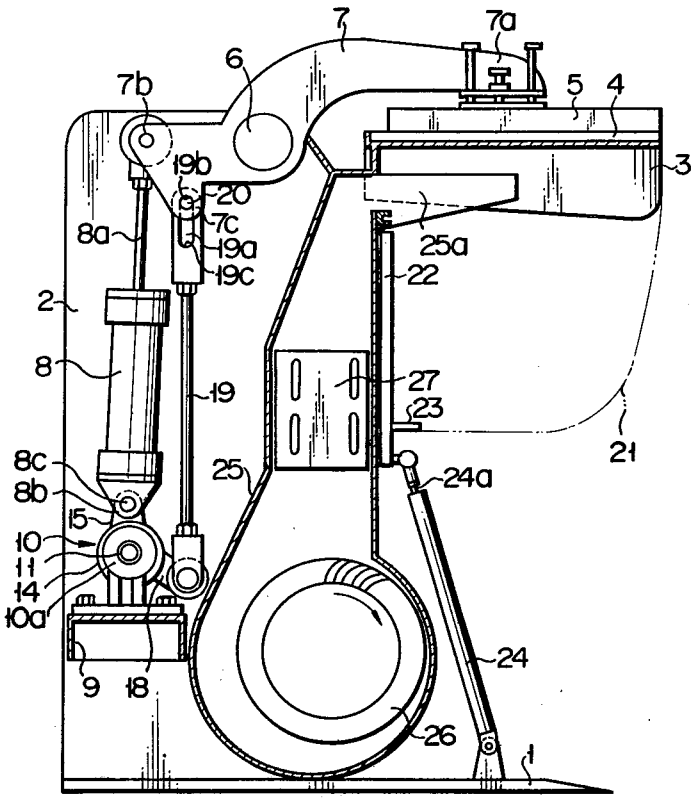
FIG. 2 is a left side elevational view, partly in cross section, showing the operative state of the clothing presser in FIG. 1.

As shown in FIGS. 1 and 2 the head 5 is mounted on a forward end **7*a* of a rocking arm 7 which is swingably mounted on the upper end portions of the support plates 2 through a shaft 6. The rocking arm 7 is adapted to be swung by the actuation of a pneumatically operated piston-cylinder assembly 8. That is, the upper end of a piston rod 8*a* of the piston-cylinder assembly 8 is pivotally mounted on a rear end portion 7*b* of the rocking arm 7, and the base end of the piston-cylinder assembly 8 is connected, as described below, through a toggle mechanism 10 to a support 9 which is mounted on the support plates 2**.

Figure 3:
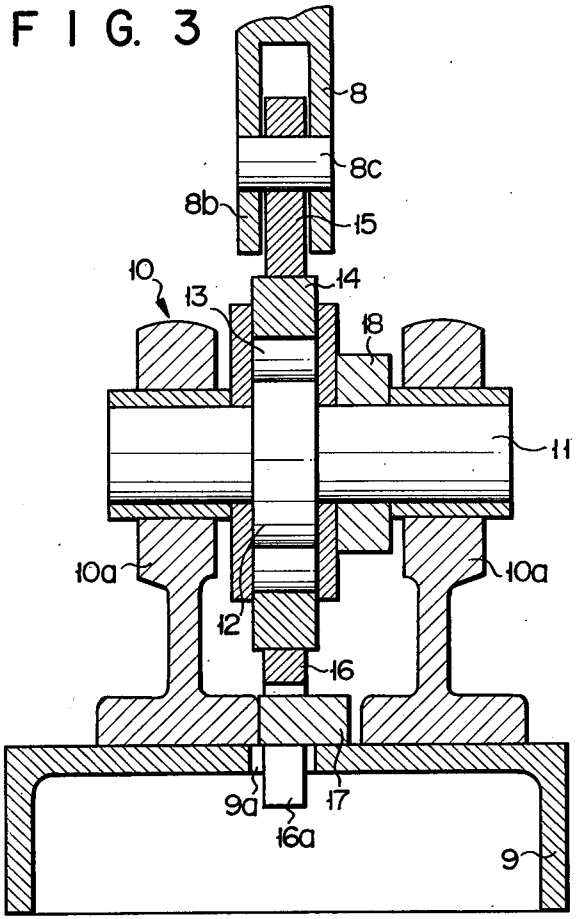
FIG. 3 is a cross-sectional view of a toggle mechanism taken on line 3—3 in FIG. 1.
Figure 4:
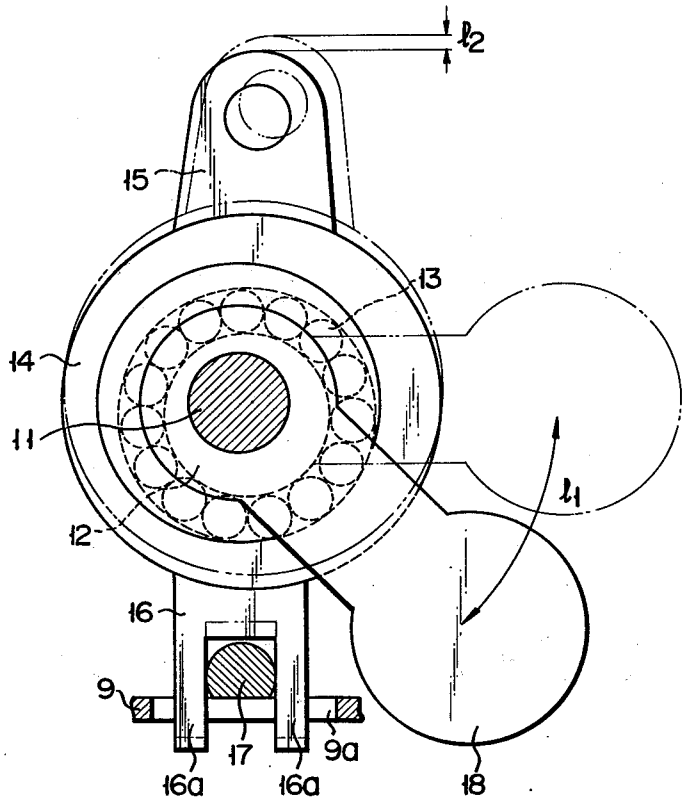
FIG. 4 is a side view of the toggle mechanism in FIG. 3.

The toggle mechanism 10 has a construction as shown in FIGS. 3 and 4. A pair of bearings **10*a* are fixed on the support 9, and a rotary shaft 11 is journaled in the bearings 10*a*. An eccentric cam 12 is integrally formed on, or secured to, the rotary shaft 11. A ring member 14 is disposed around the outer periphery of the eccentric cam 12 with roller bearings 13 arranged therebetween. On the upper portion of the outer periphery of the ring member 14 is mounted a connecting member 15 to which a lower end portion 8*b* of the piston-cylinder assembly 8 is pivotally connected through a shaft 8*c*. An inverse u-shaped anchoring member 16 is mounted on the lower end portion of the outer periphery of the ring member 14 and the lower end portion of the anchoring member 16 is loosely inserted into a through hole 9*a* in the support 9. A stop 17 fixed to the support 9 is disposed between leg portions 16*a* of the anchoring member 16 and is adapted to stop the rotation of the ring member 14. The stop 17 is substantially circular in cross section and has a flat bottom surface where it is secured to the support 9. An actuating lever 18 is securely mounted on the shaft 11. Between the actuating lever 18 and the rocking arm 7 is disposed a connecting rod 19 which is disposed substantially in parallel with the piston-cylinder assembly 8. At the upper end portion of the connecting rod 19 is provided an elongate hole or a control portion 19*a* which extends in the longitudinal direction of the connecting rod 19. A pin 20 is mounted on that intermediate portion 7*c* of the rocking arm 7 which is situated between the shaft 6 and the rear end portion 7*b* of the rocking arm 7. The pin 20 is loosely fitted in the elongate hole 19*a***.

Referring back to FIGS. 1 and 2, a bag 21 through which water vapor or air passes is provided under the buck 3. A slide member 23 is attached to the lower portion of the bag 21 and can be moved up and down along a guide 22 on the support plate 2. To the lower end of the slide member 23 is connected the upper end of a rod **24*a* of a pneumatically operated piston-cylinder assembly 24 whose lower end is pivotally mounted on the base 1. The slide member 23 is moved up and down by the actuation of the piston-cylinder assembly 24. When the rod 24*a* is in the raised position the bag 21 is collapsed as shown in FIG. 1, and when the rod 24*a* is in the lowered position the bag 21 is expanded as shown in FIG. 2. An opening of the bag 21 communicates with an outlet 25***a* at the upper end of a duct 25, and an air blowing fan or blower 26 is disposed in the lower end portion of the duct 25. A radiation or a heater 27 for heating air from the fan 26 is disposed in an intermediate portion of the duct 25. Water vapor from a boiler, not shown, is supplied to the heater 27 and is heated by it.

In operation, the slide member 23 is moved by the actuation of the piston-cylinder assembly 24 to an uppermost position where the bag 21 is collapsed as shown in FIG. 1. The waist portion of trousers is placed around the buck 3 with the front of the waist portion of the trousers on the mat 4 so that the buck 3 and bag 21 are covered with the waist portion of the trousers. The rocking arm 7 is swung, by the piston-cylinder assembly 8 and toggle mechanism 10, in a clockwise direction to permit the front of the waist portion of the trousers to be pressed between the head 5 and the buck 3.

The pressing operation of the presser will be explained in more detail.

When the piston-cylinder assembly 8 is actuated, the rod 8*a* of the piston-cylinder assembly 8 is extended, causing the rocking arm 7 to be clockwise swung around the shaft 6 to permit the head 5 to be brought into pressure contact with the mat 4 on the buck 3, as shown in FIG. 2. As a result, the front of the waist portion of the trousers is pressed on the mat 4 on the buck 3. During the initial stage of the pressing operation the pin 20 of the rocking arm 7 engages an upper hole end 19*b* of the elongate hole 19*a* of the connecting rod 19. At this stage, however, the toggle mechanism 10 does not work. When the rod 8*a* is further extended, the clockwise swinging movement of the rocking arm 7 causes the connecting rod 19 to be raised through the shaft 20 on the rocking arm 7 and in consequence the actuating lever 18 is swung in a counterclockwise direction. The distance for which the center of the actuating lever 18 travels by the swinging movement is indicated by $l_1$ as shown in FIG. 4. With the swinging movement of the actuating lever 18 the eccentric cam 12 is also counterclockwise rotated through the same angle as that of the lever 18 to cause the ring member 14 to be raised by an amount $l_2$ from a position indicated by a solid line to a position indicated by a double-dot dash line in FIG. 4. The actuating lever 18 and eccentric cam 12 are shaped so that $l_1$ is greater than $l_2$. Upon comparison between the amounts of work a force transmitted from the piston-cylinder assembly 8 to the connecting rod 19 is increased through the actuating lever 18 and eccentric cam 12 and the piston-cylinder assembly 8 is raised by a correspondingly increased force. As a result, the above-mentioned increasing force is added to the rear end 7*b* of the rocking arm 7 and the head 5 is pressed by a great force against the buck 3. Accordingly, although the force from the piston-cylinder assembly itself is restricted, the front of the waist portion of the trousers is strongly pressed between the head 5 and the buck 3.

When the pressing operation begins, the rod 24*a* of the piston-cylinder assembly 24 is retracted to move the slide member 23 downward, thereby to permit the bag 21 to be expanded as shown in FIG. 2. Then, water vapor heated through the heater 27 is sent by the fan 26 into the bag 21 to give a suitable moisture to the waist portion of the trousers through the bag 21. At the end of this operation, the supply of the water vapor is stopped and instead dry air heated by the heater 27 is conducted by the fan 26 into the bag 21. The waist of the trousers, which surrounds the bag 21 and is expanded by the expanded bag 21, is dried by the hot air introduced into the bag 21. Thereafter the supply of the dry air is stopped. The rod 8*a* of the piston-cylinder assembly 8 is retracted to cause the rocking arm 7 to be swung in a counterclockwise direction to permit the head 5 to be moved away from the front of the waist portion of the trousers on the mat 4 on the buck 3. During this process the piston-cylinder assembly 24 is actuated such that the rod 24*a* is extended to cause the bag 21 to be collapsed as shown in FIG. 1. Shortly before the rocking arm 7 is counterclockwise swung to an original position, the pin 20 on the rocking arm 7 engages a lower hole end 19*c* of the elongate hole 19*a* and in consequence the connecting rod 19 is lowered to cause the actuating lever 18, eccentric cam 12 and ring member 14 (that is, the toggle mechanism 10) to be returned to the original position.

Although this invention has been explained as pressing the front of the waist portion of the trousers, this invention is not restricted thereto. This invention can of course be applied to the pressing of a variety of clothes.

What is claimed is:

1. A clothing presser comprising:

a base;

upright support plates mounted on the base;

a stationary ironing buck fixed to the upright support plates;

a movable ironing head for pressing the stationary ironing buck;

a rocking arm having the movable ironing buck fixed to one end thereof and adapted to swing about a shaft provided on the upright support plates;

a piston-cylinder assembly connected to the other end of said rocking arm for swinging the rocking arm; and a toggle mechanism comprising a rotary shaft rotatably mounted on the upright support plates, an eccentric cam fixed to the rotary shaft, a ring member surrounding the eccentric cam and supporting the piston-cylinder assembly to cause the piston-cylinder assembly to move in a longitudinal direction thereof by the rotation of the eccentric cam, an actuating lever extending crosswise of the piston-cylinder assembly from the rotary shaft, and a connecting rod disposed substantially in parallel with the piston-cylinder assembly, said connecting rod having one end operatively connected to that intermediate portion of the rocking arm which is situated between the shaft and said other end of the rocking arm and having the other end connected to the free end of the actuating lever.

2. A clothing presser according to claim 1, wherein said connecting rod is provided at said one end thereof with an elongate hole shaped control portion which extends along the connecting rod and into which a pin provided on said intermediate portion of the rocking arm is fitted, said control portion having a hole end adjacent to said one end of the connecting rod adapted to be engageable with the pin when the movable ironing head begins to contact with the stationary ironing buck.

3. A clothing presser according to claim 2, wherein said control portion is provided with another hole end which is remote from said one end of the connecting rod and is adapted to be engageable with the pin just before the rocking arm returns to its original position.

* * * * *